US009539490B2

(12) United States Patent
Park

(10) Patent No.: US 9,539,490 B2
(45) Date of Patent: Jan. 10, 2017

(54) LOW-MAINTENANCE BOCCE COURT

(71) Applicant: Philip Park, Walnut Creek, CA (US)

(72) Inventor: Philip Park, Walnut Creek, CA (US)

( * ) Notice: Subject to any disclaimer, the term of this patent is extended or adjusted under 35 U.S.C. 154(b) by 41 days.

(21) Appl. No.: 14/720,349

(22) Filed: May 22, 2015

(65) Prior Publication Data

US 2016/0339330 A1 Nov. 24, 2016

(51) Int. Cl.
*B32B 5/24* (2006.01)
*B32B 5/30* (2006.01)
*A63D 1/04* (2006.01)

(52) U.S. Cl.
CPC ..... *A63D 1/04* (2013.01)

(58) Field of Classification Search
CPC ..... B32B 5/24; B32B 5/30; E01C 13/06
See application file for complete search history.

(56) References Cited

U.S. PATENT DOCUMENTS 8,366,561 B2 * 2/2013 Moosdorf ..... E01C 13/02 428/17

* cited by examiner

*Primary Examiner* — Alexander Thomas
(74) *Attorney, Agent, or Firm* — Leydig, Voit & Mayer, Ltd.

(57) ABSTRACT

A low-maintenance bocce court surface comprising a base layer with a horizontal backing and vertical polymer fibers attached to the backing; an infill layer of a particulate infill material distributed between the fibers of the base layer; and a surface layer distributed over the infill layer and covering the polymer fibers, wherein the surface layer comprises crushed seashells, and wherein the vertical polymer fibers of the base layer extend part-way into the surface layer; as well as a bocce court comprising the low-maintenance bocce court surface, and a method of preparing the bocce ball court surface.

17 Claims, 2 Drawing Sheets

LOW-MAINTENANCE BOCCE COURT

BACKGROUND OF THE INVENTION

Bocce is traditionally played on courts of clay, sometimes with sand or crushed oyster shells as a surface layer. These traditional bocce courts require constant maintenance and proper hydration to remain playable. Frequent raking, rolling and hydrating is needed to keep the playing surface level and smooth, and to remove grooves and indentations left from previous rounds of play. The rigorous maintenance requirements of traditional bocce courts have led others to employ synthetic materials, particularly artificial grass, as a surface for bocce courts. Conventional synthetic surfaces, however, do not provide the proper ball bounce, rolling speed and resistance, or other characteristics of traditional bocce courts. Thus, there remains a need for improved low-maintenance bocce courts.

BRIEF SUMMARY OF THE INVENTION

The invention provides a low-maintenance bocce court surface comprising a base layer with a horizontal backing and vertical polymer fibers attached to the backing; an infill layer of a particulate infill material distributed between the fibers of the base layer; and a surface layer distributed over the infill layer and covering the polymer fibers, wherein the surface layer comprises crushed seashells. The vertical polymer fibers of the base layer extend part-way into the surface layer, providing a bocce court surface with the playability of a traditional oyster-flour court, but with less maintenance. A bocce court comprising the low-maintenance bocce court surface also is provided.

In a related aspect, the invention provides method of preparing a low-maintenance bocce court surface, the method comprising (a) providing a base layer comprising a horizontal backing and vertical polymer fibers attached to the backing; (b) distributing an infill material between the fibers of the base layer to form an infill layer, wherein the infill material is a particulate material; and (c) distributing a surface layer over the infill layer to cover the polymer fibers, wherein the surface layer comprises crushed seashells; wherein the vertical polymer fibers of the base layer extend into the surface layer.

BRIEF DESCRIPTION OF THE SEVERAL VIEWS OF THE DRAWING(S)

DETAILED DESCRIPTION OF THE INVENTION

Figure 1:
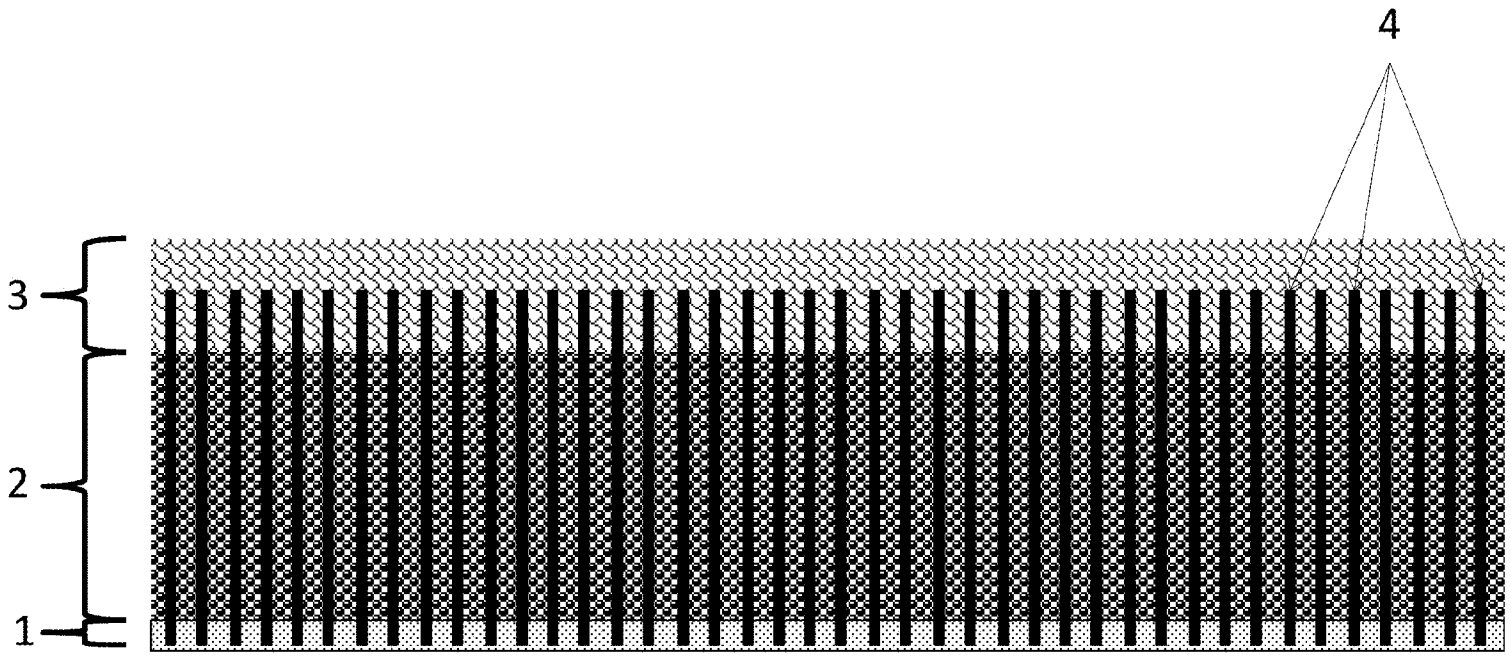
FIG. 1 is a cross-sectional diagram of a low-maintenance bocce court surface in accordance with the invention.

The invention provides a low-maintenance bocce court surface comprising a base layer with a horizontal backing and vertical polymer fibers attached to the backing; an infill layer of a particulate infill material distributed between the fibers of the base layer; and a surface layer distributed over the infill layer and covering the polymer fibers, wherein the surface layer comprises crushed seashells.

The base layer comprising a horizontal backing and vertical polymer fibers attached to the backing provide a material that is similar to an artificial grass or turf. The backing material can be provided by any material to which grass-like polymer fibers may be attached. Various woven, non-woven, or spun-bonded fabrics are known for such use. Any suitable fabric face weight can be used (e.g., about 30-40 oz. per sq. yard). It is preferred that the backing layer is made of a stable, weather resistant material such as polyolefin, polyurethane, rubber, nylon, or other similar material. The backing material can be supple and flexible so that it can conform to a base layer supporting the backing material. The backing material is, desirably, porous to allow water to flow through the backing material.

The polymer fibers attached to the backing material can be any type of fiber typically used in artificial grass or turf materials. For instance, the fibers can comprise monofilament fibers, split-film fibers, or a combination thereof. The fibers can comprise any suitable polymer, including thermoplastic polymer fibers, such as polyolefins, polyethylene, polypropylene, and copolymers of ethylene and propylene, polyesters, particularly polyethylene terephthalate, and polyamides, particularly nylon. The polymer fibers can have any suitable size, such as a yarn size of about 6000 to 9000 denier. The polymer fibers may have any suitable arrangement. For instance, the polymer fibers can be arranged and attached to the backing material as small groups of smaller filaments, or individual larger filaments.

The polymer fibers are vertically oriented relative to the horizontal backing material, meaning that the polymer fibers extend substantially upward and away from the backing layer. The vertical polymer fibers can have any suitable length. In one embodiment, the fibers have a length sufficient to provide a pile height of about ½" (12 mm) to about 1" (26 mm), or about ½" (12 mm) to about ⅝" (16 mm).

The bocce court surface comprises an infill layer of an infill material dispersed throughout and between the vertical polymer fibers and over the backing material. The infill material is a particulate material, and can be any infill material that can be in-filled between the vertical polymer fibers, provided that the infill layer gives surface playability characteristics suitable for bocce play. Suitable materials include as natural and synthetic sand (e.g., silica, quartz, glass, or polymer sand). In some embodiments the infill material comprises about 50% or more (e.g., about 75% or more, 85% or more, or 90% or more) sand. In some embodiments, the sand is a sub-angular sand, particularly a sub-angular quartz or silica sand.

The infill material can have a size suitable for infilling between the polymer fibers. In some embodiments, the particles of the infill material can have a particle size distribution such that about 65% or more of the particles (e.g., about 70% or more, about 75% or more, about 80% or more, or even about 85% or more), by weight, pass through a sieve size of about #50 (about 0.3 mm). Optionally, about 85% or more of the particles (e.g., about 90% or more, about 95% or more, or about 97% or more), by weight, pass through a sieve size of about #40 (about 0.4 mm). Alternatively, or in addition, the infill particulate can have a particle size distribution such that about 35% or more (e.g., about 40% or more, about 45% or more, about 50% or more, about 55% or more, about 60% or more, or even about 65% or more) of the particles, by weight, are retained at a sieve size of about #70 (about 0.2 mm) or smaller. Optionally, about 70% or more (e.g., about 75% or more, about 80% or more, about 85% or more, about 90% or more, or about 95% or more of the particles), by weight, are retained at a sieve size of about #100 (about 0.15 mm) or smaller. Alternatively, or in addition, the infill material has a particle size distribution such that about 50% or more (e.g., about 55% or more, about 65% or more, about 70% or more, about 75% or more, about 80% or more, or about 85% or more) of the infill material passes through a sieve size of about #40 or greater (about 0.4 mm or more) and is retained in a sieve size of about #100 or smaller (about 0.1 mm). Thus, for instance, the infill material can have a particle size distribution by which about 50 wt. % or more of the particles have a sieve size of #70-#100, and about 90 wt. % or more of the particles have a sieve size of #50-#140.

The infill layer does not completely cover the vertical polymer fibers. Thus, the infill layer has a depth measured from the backing material that is less than the length of the polymer fibers. Thus, for instance, the infill layer can have a depth of about 10% or more (e.g., about 20% or more, about 30% or more, about 50% or more, or even about 75% or more) the length of the polymer fibers, provided the depth is less than the full length of the polymer fibers. In some embodiments, the infill layer has a depth that is about 95% or less (about 90% or less, about 80% or less, about 75% or less, about 60% or less, or about 50% or less) of the length of the polymer fibers.

A surface layer comprising crushed seashells is applied over the infill layer. The surface layer can be, for instance, a layer of oyster flour of the type used for bocce ball courts. Oyster flour and other crushed seashell based materials are commercially available. In some embodiments, the surface layer comprises about 50% or more (e.g., about 75% or more, about 85% or more, or about 90% or more) oyster flour. The surface layer can further comprise sand and/or polymer particles (e.g., EPDM particles) to adjust ball roll speed as desired.

The surface layer is applied so as to cover the vertical polymer fibers. In preferred embodiments, the surface layer has a depth sufficient to completely cover the infill layer and vertical polymer fibers, so that the vertical polymer fibers cannot be seen. In other words, the combined depth of the infill layer and surface layer is greater than the length of the polymer fibers. In some embodiments, the surface layer has a depth (thickness) above the vertical polymer fibers of about 1/16" (1 mm) or more, about 1/8" (3 mm) or more, about 3/16" (4 mm) or more, about 1/4" (6 mm) or more, about 5/16" (7 mm) or more, about 3/8" (9 mm) or more, about 7/16" (10 mm) or more, or even about 1/2" (12 mm) or more. In addition or alternatively, the depth of the surface layer will not be greater than about 1" (26 mm) (e.g., not greater than about 1/2" (12 mm)) above the vertical polymer fibers. The total depth (thickness) of the surface layer required to achieve the desired depth (thickness) of surface material above the vertical polymer fibers will depend on the depth (thickness) of the infill material layer. In some embodiments, the surface layer has a total depth (thickness) as measured from the infill layer of about 0.25" (5 mm) or more (e.g., about 0.3" (7 mm) or more, or about 0.5" (10 mm) or more) and/or about 1" (26 mm) or less, such as about 0.5" (12 mm) or less.

Since the infill layer has a depth that is less than the length of the vertical polymer fibers, the vertical polymer fibers extend beyond the infill layer and part-way into the surface layer. Without wishing to be bound by any particular theory or mechanism of action, it is believed that the protrusion of the vertical fibers into the surface layer stabilizes the surface layer to provide a bocce court surface with the playability of a traditional oyster-flour court, but with greater resistance to developing dents and ruts from bocce play. The court, thus, requires less maintenance.

The bocce ball court surface can be positioned over a suitably supportive surface. The surface can be, for instance, a course of crushed rock or a concrete pad. The bocce court surface positioned over a supportive surface provides a low bounce surface needed for the sport of bocce ball. The court surface desirably provides a ball rebound of about 20% or less (e.g., about 15% or less or even about 10% or less) than the ball rebound of a concrete surface. Ball rebound, for the purposes discussed herein is determined by dividing the height of the rebound of a plastic resin bocce ball with a diameter of 107 mm and weight of 920 g dropped on the bonding layer and force reduction layer laid over a concrete slab by the height of the rebound of the same bocce ball dropped from the same height directly on a concrete slab.

The bocce court surface positioned over a supportive surface provides a rolling resistance appropriate for traditional bocce play. Rolling resistance can be measured using a stimpmeter, which is a ramp with a 145° V-shaped groove extending along its length and set to the ground at a given angle. A ball released from a given height on the ramp is allowed to roll onto the bocce court surface and the distance that the ball rolls away from the ramp reflects the rolling resistance of the surface. The measurement is repeated until three measurements within 8" of each other are obtained, and an average of the three measurements is used. According to one embodiment, the court surface has a stimpmeter rolling distance of about 15-25 feet, such as about 7-12 feet, when measured using a plastic resin bocce ball with a diameter of 107 mm and weight of 920 g and a stimpmeter with an incline of 35° from a level surface and a release height of 9 inches.

Provided herein is a bocce court comprising the bocce court surface positioned over a supportive surface, as described herein. The bocce court typically has a substantially rectangular shape with a width and length suitable for bocce play. Generally, the bocce court will have a width of about 8 feet to about 13 feet and a length of about 60 feet to about 91 feet.

The bocce court can comprise a curb around the perimeter of the rectangular shaped court with a height above the court surface sufficient to retain bocce balls inside the court perimeter. Typically, the curb extends above the surface of the court by about 4 inches to about 12 inches. The bocce court may also have bumpers along a portion of the curb that provides the sidewalls of the court (along the lengthwise/longest dimension of the court). The bumpers may be made of a material that provides suitable rebound for bocce play (e.g., natural or synthetic wood, rubber, or plastic (polymer) material of suitable hardness). The bocce court also may have a backboard at one end of the court, perpendicular to the sides of the court, of a material suitable to reduce rebound of a bocce ball striking the backboard (e.g., natural or synthetic wood, rubber, or plastic (polymer) material of suitable hardness).

The bocce court desirably has a drainage system for removing water from the surface of the court and/or the ground beneath the court. The drainage system can comprise weep holes or other portals in the curb surrounding the court through which water can escape, as well as drainage tiles surrounding or beneath the base material.

Other materials and components typically used in the installation of a bocce court can also be used in accordance with the invention. For instance, a leveling compound may be used over the concrete slab to achieve a level surface as needed. Also, adhesives may be used to adhere any of the various layers to an adjacent layer.

The bocce court can be manufactured by any suitable method. In one aspect of the invention, the bocce court can be prepared by (a) providing a base layer comprising a horizontal backing and vertical polymer fibers attached to the backing; (b) distributing a particulate infill material between the fibers of the base layer to form an infill layer; and (c) distributing a surface layer over the infill layer to cover the polymer fibers, wherein the surface layer comprises crushed seashells; wherein the vertical polymer fibers of the base layer extend into the surface layer. The method can further comprising positioning the base layer over a crushed rock course or concrete pad, typically before distributing the infill material between the fibers of the base layer.

The infill layer can be distributed between the fibers of the base layer by any suitable method, such as by evenly distributing the infill material over the base layer and polymer fibers, and sweeping or vibrating the base layer and infill material to cause the infill material to be distributed between the fibers of the base layer.

Similarly, the surface layer can be applied over the infill layer and polymer fibers by any suitable method. For instance, the surface layer material can be distributed evenly over the infill layer and polymer fibers, and the surface layer can be tamped, rolled, vibrated, and/or raked, to provide a level playing surface with the desired amount of compaction.

The following example further illustrates the invention but, of course, should not be construed as in any way limiting its scope.

EXAMPLE

Figure 2:
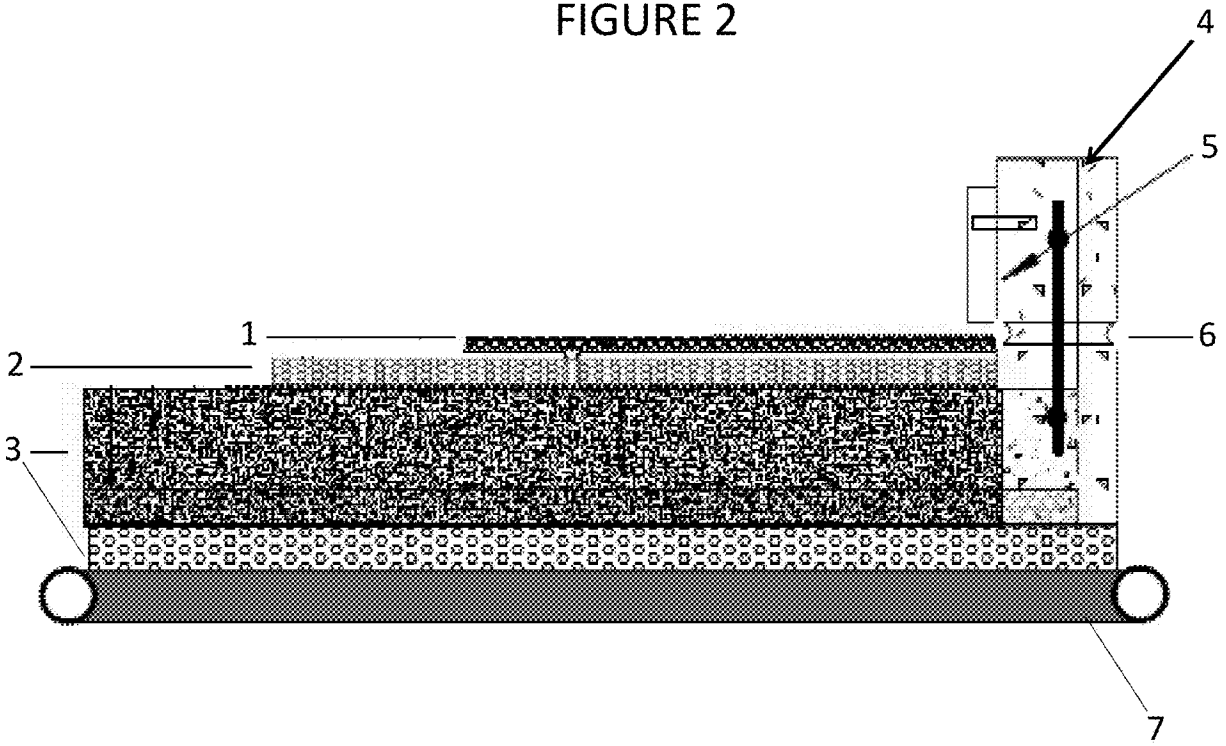
FIG. 2 is a cross-sectional diagram of a bocce ball court comprising the low-maintenance bocce court surface in accordance with the invention.

FIGS. 1 and 2 illustrate one embodiment of a bocce court surface (FIG. 1) and bocce ball court (FIG. 2) in accordance with the invention described herein. The Figures are not drawn to scale, but merely represent the approximate position of elements relative to one another.

FIG. 1 provides a magnified view of the cross-section of a bocce court surface comprising a base layer 1 with polymer filaments 4 extending therefrom. The base layer 1 can be provided, for instance, by a backing material comprising a 5-20 oz polymer (single layer or multi-layer) fabric with drainage perforations. The polymer filaments 4 can be provided, for example, by polyethylene fibers (8000 Denier) with a gauge of about 3/16"-3/8" and pile height of about 1/2"-5/8".

An infill material of sub-angular quartz/silica sand is brushed into the polymer filaments using a power broom to provide an infill layer 2 with a depth that is less than the length of the polymer filaments. A surface layer 3 of crushed oyster shells and oyster flour, with optional addition of sand and/or EPDM particles to adjust ball roll speed, is applied over the infill layer, vibrated, and compacted to a depth of about 1/8" or more over the polymer filament length, so that the polymer filaments are covered by the surface layer.

Referring to FIG. 2, the bocce court surface 1 can be supported by compacted base rock 3 (e.g., about 4" class 2 base rock) and 1/2"-1" decomposed granite finish/leveling course 2. A perimeter curb 4 (e.g., concrete) can be installed and, optionally, bumper boards 5 (e.g., wood). Weep holes 6 can be provided to drain water from the court surface, and a drainage system 7 (e.g., perforated drain line) can, optionally, be installed beneath the base rock 3.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A low-maintenance bocce court surface comprising:

(a) a base layer comprising a horizontal backing and vertical polymer fibers attached to the backing;

(b) an infill layer comprising an infill material distributed between the fibers of the base layer, wherein the infill material is a particulate material; and (c) a surface layer distributed over the infill layer and covering the polymer fibers, wherein the surface layer comprises crushed seashells, wherein the vertical polymer fibers of the base layer extend into the surface layer.

2. The bocce court surface of claim 1, wherein the polymer fibers comprise monofilament fibers, split-film fibers, or a combination thereof.

3. The bocce court of claim 1, wherein the vertical polymer fibers provide a pile height of 1/2" to 1", or 1/2" to 5/8".

4. The bocce court surface of claim 1, wherein the base layer backing material comprises a urethane pad layer and a polymer fabric layer, the base layer polymer fibers have a yarn size of about 6000 to 9000 denier, and the base layer has a face weight of about 30-40 oz per sq. yd.

5. The bocce court surface of claim 1, wherein the infill layer has a depth of about 10% or more the length of the polymer fibers, and about 90% or less the length of the polymer fibers.

6. The bocce court surface of claim 1, wherein the infill material comprises 70 wt. % or more sand.

7. The bocce court surface of claim 6, wherein the infill material is a sub-angular sand.

8. The bocce court surface of claim 1, wherein the infill material has a particle size distribution by which about 50 wt. % or more of the particles have a sieve size of #70-#100, and about 90 wt. % or more of the particles have a sieve size of #50-#140.

9. The bocce court surface of claim 1, wherein the surface layer has a depth of ⅛" or more above the polymer fibers.

10. The bocce court surface of claim 1, wherein the surface layer comprises 90 wt. % or more oyster flour.

11. A bocce court comprising the bocce court surface of claim 1 and a crushed rock course or concrete pad supporting the base layer.

12. The bocce court of claim 11, wherein the court provides a bocce ball rebound of about 10% or less, wherein the bocce ball rebound is the height of the rebound of a plastic resin bocce ball with a diameter of 107 mm and weight of 920 g dropped on the bocce court from given height divided by the height of the rebound of the same bocce ball dropped from the same height on a concrete surface.

13. The bocce court of claim 11, wherein the court has a stimpmeter rolling distance of about 7-12 feet as measured using a plastic resin bocce ball with a diameter of 107 mm and weight of 920 g and a stimpmeter with an incline of 35° from a level surface and a release height of 9 inches.

14. The bocce court of claim 11 having a substantially rectangular shape with width of about 8 feet to about 13 feet, and a length of about 60 feet to about 91 feet.

15. The bocce court of claim 14, further comprising a curb around the perimeter of the rectangular shaped court, wherein the curb extends above the surface of the court by about 4 inches to about 12 inches.

16. A method of preparing a low-maintenance bocce court surface, the method comprising:

(a) providing a base layer comprising a horizontal backing and vertical polymer fibers attached to the backing;

(b) distributing an infill material between the fibers of the base layer to form an infill layer, wherein the infill material comprises a particulate material; and (c) distributing a surface layer over the infill layer to cover the polymer fibers, wherein the surface layer comprises crushed seashells;

wherein the vertical polymer fibers of the base layer extend into the surface layer.

17. The method of claim 16, further comprising positioning the base layer over a crushed rock course or concrete pad.

* * * * *